US008261635B2

(12) United States Patent
Lee et al.

(10) Patent No.: US 8,261,635 B2
(45) Date of Patent: Sep. 11, 2012

(54) ONE-DIRECTION RACHET WRENCH

(76) Inventors: Tsan-Chang Lee, Taichung (TW); Yueh-Li Wang, Taichung (TW)

( * ) Notice: Subject to any disclaimer, the term of this patent is extended or adjusted under 35 U.S.C. 154(b) by 536 days.

(21) Appl. No.: 12/610,376

(22) Filed: Nov. 2, 2009

(65) Prior Publication Data

US 2011/0100165 A1 May 5, 2011

(51) Int. Cl.
*B25B 13/46* (2006.01)

(52) U.S. Cl. ..... 81/60; 81/62; 81/63.2

(58) Field of Classification Search ..... 81/60, 62, 81/63.2

See application file for complete search history.

(56) References Cited

U.S. PATENT DOCUMENTS 5,957,009 A * 9/1999 McCann ..... 81/63.2
6,282,991 B1 * 9/2001 Hu ..... 81/63.2
2002/0162424 A1 * 11/2002 Hu ..... 81/60

* cited by examiner

*Primary Examiner* — Lee D Wilson
*Assistant Examiner* — Shantese McDonald

(57) ABSTRACT

The present invention relates a one-direction ratchet wrench, which has a driving head with a first cavity and a second cavity. There are walls located on the top and the bottom portions of the second cavity, and a pin hole is extended from the second cavity to the walls. A ratchet wheel is rotatably mounted in the first cavity, and there is a plurality of ratchet teeth in the outer periphery of the ratchet wheel and a receptacle formed in the middle to receive and drive workpieces. A pawl is located in the second cavity and one of its sides has a plurality of teeth engaged with the ratchet teeth. A pin is inserted in a pin hole for an elastic assembly to hitch on. The elastic assembly has a first elastic element and a second elastic element. One end of the second elastic element links to the pawl and the other end links to the first elastic element. The first elastic element hitches on the pin and one of its ends sticks against the inner wall of the second cavity. Thus, the present invention is able to effectively control workpieces being driven in one-direction.

11 Claims, 12 Drawing Sheets

ONE-DIRECTION RACHET WRENCH

FIELD OF THE INVENTION

The present invention relates to a one-direction ratchet wrench, particularly to a one-direction ratchet wrench which applies a pin and an elastic assembly to effectively control workpieces being driven in one-direction and also has advantages such as simplified components, easy for assembly and reduced cost.

BACKGROUND OF THE INVENTION

According to the prior art of a one-direction ratchet wrench disclosed in U.S. Pat. No. 6,539,825, it comprises a driving head with a ratchet wheel and a pawl, and a drive member mounted in the hole of the head. Inasmuch as an elastic element is attached between the drive member and the pawl for biasing the teeth of the pawl to engage with the teeth of the drive member, the head can be employed to drive the ratchet wheel moving in single direction. Apparently, it lacks of sufficient elasticity between the drive member and the head. On the other hand, because the drive member can move freely relative to the head, the elasticity of the elastic element is not able to be effectively applied on the pawl. During the driving process, the drive member bears reacting force to rotate freely and causes extremely unstable situation. Not only can it generate noise, but also damage components easily. Furthermore, there is no mechanic design for pincers to take out the annular hook from the head, and it causes inconvenience for maintaining the components inside the head. It is difficult to drill holes for the drive member to be pinned on, and it increases cost as well.

SUMMARY OF THE INVENTION

The first object of the present invention is to provide a one-direction ratchet wrench which applies a pin and an elastic assembly to effectively control workpieces being driven in single direction and also has advantages of simplified components, easy for assembly and reduced cost. In order to achieve the foregoing object, a ratchet wheel is rotatably mounted in a first cavity of a driving head and on a sidewall, near the handle of the wrench, of the first cavity has a second cavity for a pawl to be mounted. There are walls on the top and the bottom portions of the second cavity, and a pin hole is extended from the second cavity to the walls. A pin located in the second cavity is inserted through the pin hole and is held by an elastic assembly, which includes a first elastic element linking with a second elastic element. The first elastic element hitches on the pin, and one of its distal ends extends an elastic push element to stick against the wall of the second cavity. One distal end of the second elastic element is connected with the pawl.

The second object of the present invention is to provide a one-direction ratchet wrench which is easy for assembly and maintenance. In order to achieve the foregoing object, a convex trough is defined on the top wall. The convex trough communicates with a first annular groove, and two free ends of an annular hook are extended into the convex trough. Therefore, pincers can reach in thru-holes of the free ends on the annular hook to detach the annular hook.

DETAILED DESCRIPTION OF THE PREFERRED EMBODIMENT

Figure 1:
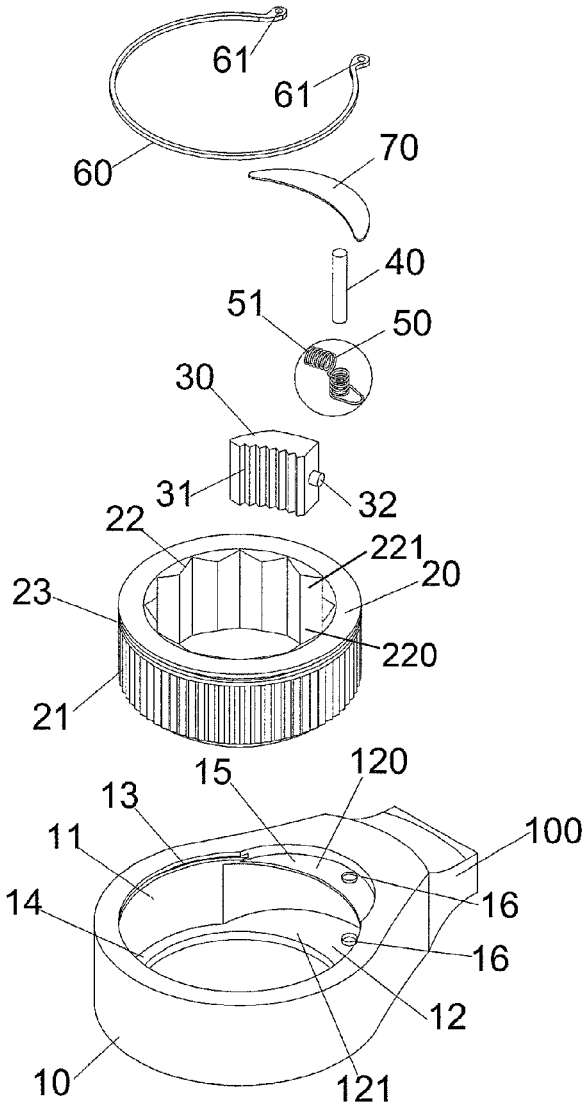
FIG. 1 is an exploded view of the first embodiment in accordance with the present invention.
Figure 2:
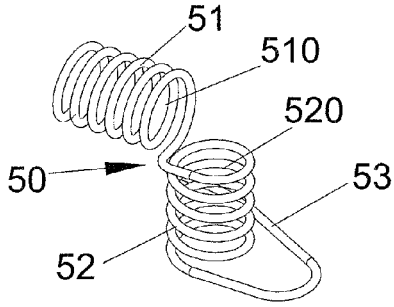
FIG. 2 is an enlarged drawing of the elastic assembly in accordance with the present invention.

Referring to FIGS. 1 and 2, the one-direction ratchet wheel of the present invention comprises a driving head 10, a ratchet wheel 20, a pawl 30, a pin 40, an elastic assembly 50, an annular hook 60 and a lid 70. Functions of above components are detailed as below:

The head 10 with a penetrated hole, first cavity 11, is extended from one end of a handle 100. There is a curved second cavity 12 with a smaller diameter on a sidewall of the first cavity 11, and the center of the second cavity 12 is located within the first cavity 11 area. A top wall 120 and a bottom wall 121 are formed on the top and the bottom portions of the second cavity 12 respectively. The second cavity 12 communicates with the first cavity 11 whose inner sidewall has a first annular groove 13 near its top portion and a protruded annular fringe 14 near the bottom. The top wall 120 has a curved convex trough 15 whose center is on the same axis as the center of the second cavity 12, and the diameter of the convex trough 15 is less than or equal to the diameter of the second cavity 12. The convex trough 15 relatively communicates with the first annular groove 13. The top wall 120 has a pin hole 16, whose top portion links both the second cavity 12 and the convex trough 15 and bottom portion ends at the top indent of the bottom wall 121.

The ratchet wheel 20 is rotatably mounted in the first cavity 11 of the head 10, and it is held by the annular fringe 14 to avoid falling apart from the wrench. There is a plurality of ratchet teeth 21 distributed on the outer periphery of the ratchet wheel 20, and there is a receptacle 22 formed at the middle of the ratchet wheel 20. The receptacle 22 is employed to receive and drive workpieces. A second annular groove 23 is at the top portion of the outer periphery of the ratchet wheel 20 and is located exactly corresponding to the first annular groove 13. Referring to FIG. 1, the receptacle 22 of the ratchet wheel 20 has an outright penetrated receiving hole 220, whose inner wall has twelve consecutive V shaped troughs 221 annularly formed to hold and drive workpieces.

The pawl 30 is located in the second cavity 12 of the head. One of its sides has a plurality of teeth 31 engaged with the ratchet teeth 21 and the other side has a protruded column 32.

The pin 40 is a cylindrical pillar and is inserted in the pin hole 16.

The elastic assembly 50 is placed inside the second cavity 12 and it comprises a first elastic element 52 and a second elastic element 51. The first elastic element 52 has a first end, a second end and a first loop 520 extending through the first end and the second end. A push element 53 is extended outwards from the first end in the opposite direction of the first loop 520 which is employed to hold onto the pin 40. The push element 53 is elastic and it is stuck against the wall of the second cavity 12. When the push element 53 sticks against the wall of the second cavity 12, it will generate elasticity to make the first elastic element 52 generate a torque relative to the pin 40. The second elastic element 51 also has a first end, a second end and a second loop 510. The second loop 510 extends through the first end and the second end. The first end of the second loop 510 links with the second end of the first elastic element 52, and the second end of the second loop 510 is a free end employed to connect with the pawl 30. There is a ninety degree angle between the axis of the second loop 510 and the axis of the first loop 520. The second elastic element 51 is effectively connected with the pawl 30 due to the torque from the first elastic element 52 pushing the second elastic element 51. Referring to FIG. 2, the first elastic element 52 and the second elastic element 51 are spirally formed by the same metal wire, and the first loop 520 and the second loop 510 are looped within the coils.

The C shaped annular hook 60 is flexible. Its outer periphery is engaged in the first annular groove 13, and its inner periphery is engaged in the second annular groove 23. In as much as the ratchet wheel 20 is held by the annular hook 60, it is rotatably mounted within the first cavity 11. The two free ends of the annular hook 60 are extended into the convex trough 15, and there are two thru-holes 61 formed in the two ends for pincers to reach in. Both of the thru-holes 61 are located in the convex trough 15 as well.

The shape of the lid 70 is in accordance with the contour of the convex trough 15. The top of the lid 70 is pressed and secured by the two free ends of the annular hook 60, so the lid 70 is able to cover the convex trough 15 to seal up the pin 40.

Figure 3:
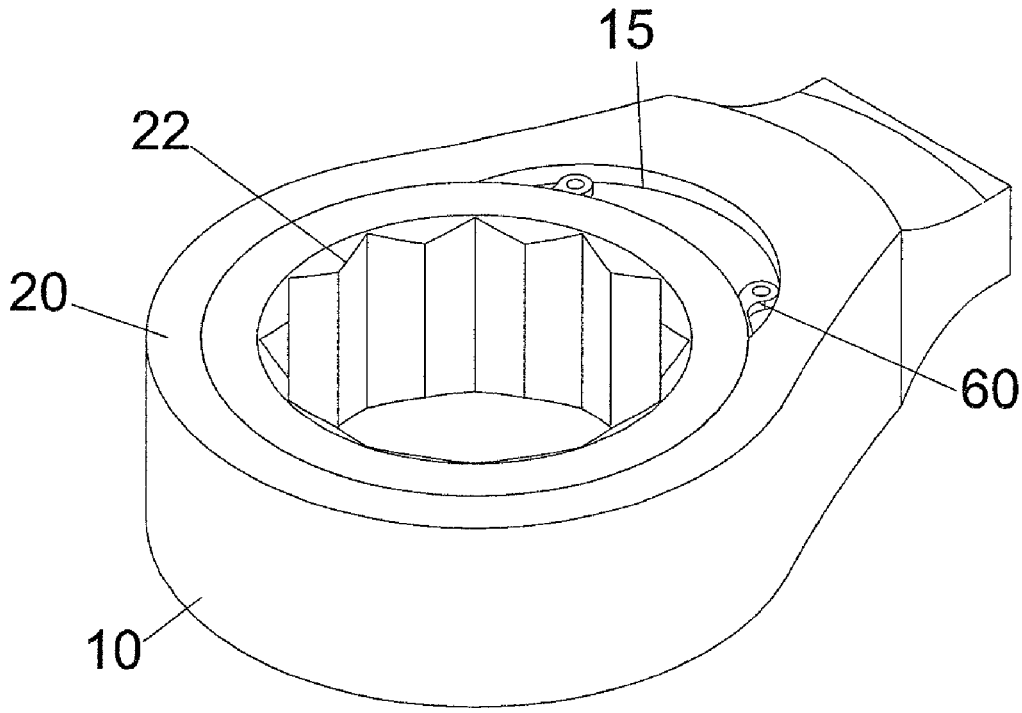
FIG. 3 is an assembly view of the first embodiment in accordance with the present invention.
Figure 5:
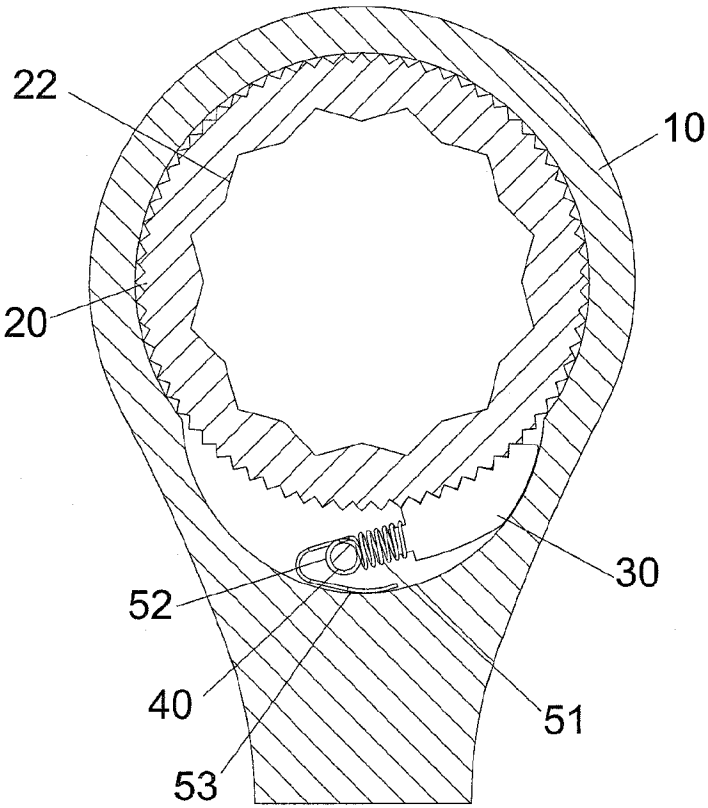
FIG. 5 is a cross sectional view taken along line B-B in FIG. 4.
Figure 4:
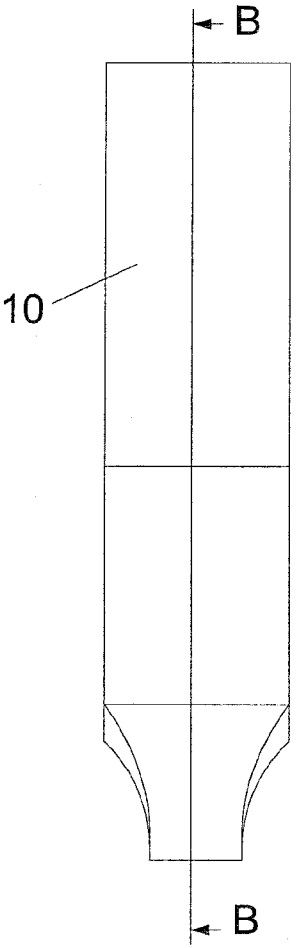
FIG. 4 is a side view of the first embodiment in accordance with the present invention.

Referring to FIGS. 3 to 5, the ratchet wheel 20 is rotatably mounted in the first cavity 11 of the head 10. The pawl 30, whose teeth 31 are engaged with the ratchet teeth 21, is located in the second cavity 12. The pin 40 is inserted in the pin hole 16 of the head 10. The second elastic element 51 of the elastic assembly 50 is hitched on the column 32 of the pawl 30 by its second loop 510, and the first elastic element 52 is hitched on the pin 40 by the first loop 520. The push element 53 sticks against the wall of the second cavity 12, and the elasticity generated by the elastic assembly 50 makes the pawl 30 to engage with the ratchet wheel 20.

Figure 7:
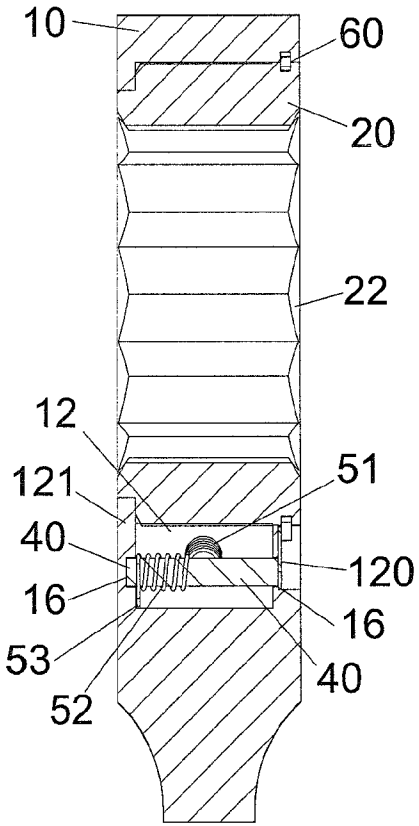
FIG. 7 is a cross sectional view taken along line C-C in FIG. 6.
Figure 6:
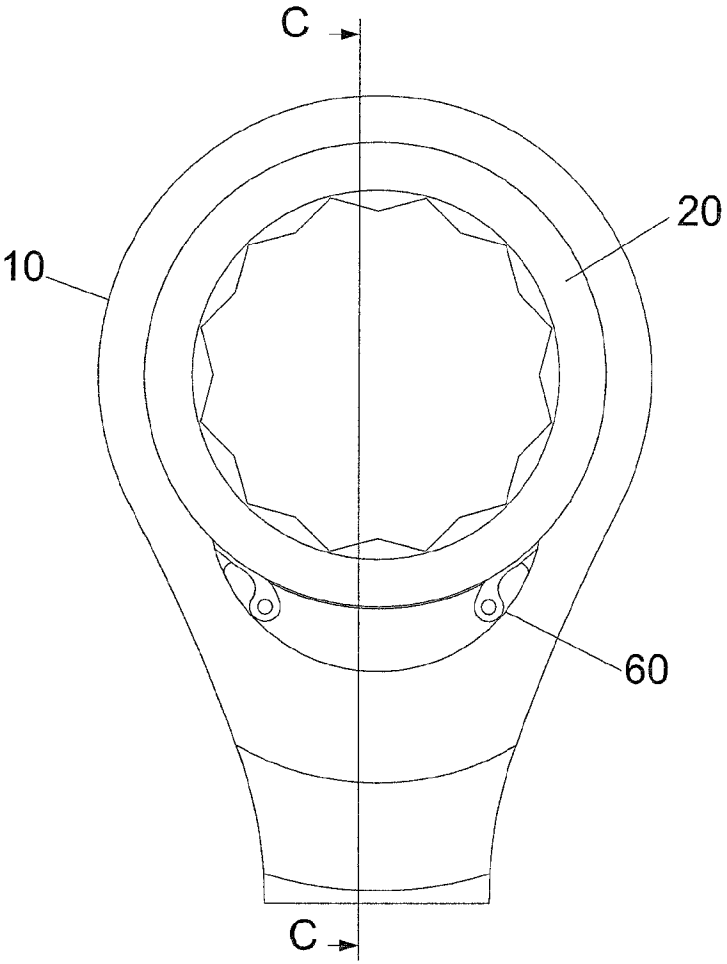
FIG. 6 is a top view of the first embodiment in accordance with the present invention.

Referring to FIGS. 6 and 7, the pin 40 penetrates the pin hole 16 to the bottom wall 121. The bottom end of the first elastic element 52 of the elastic assembly 50 props against the bottom wall 121 of the second cavity 12. The lid 70 covers the convex trough 15 to seal up the top of the pin 40. The annular hook 60 is embedded between the first annular groove 13 of the head 10 and the second annular groove 23 of the ratchet wheel 20, and its two free ends are extended into the convex trough 15 to lock the lid 70.

Figure 8:
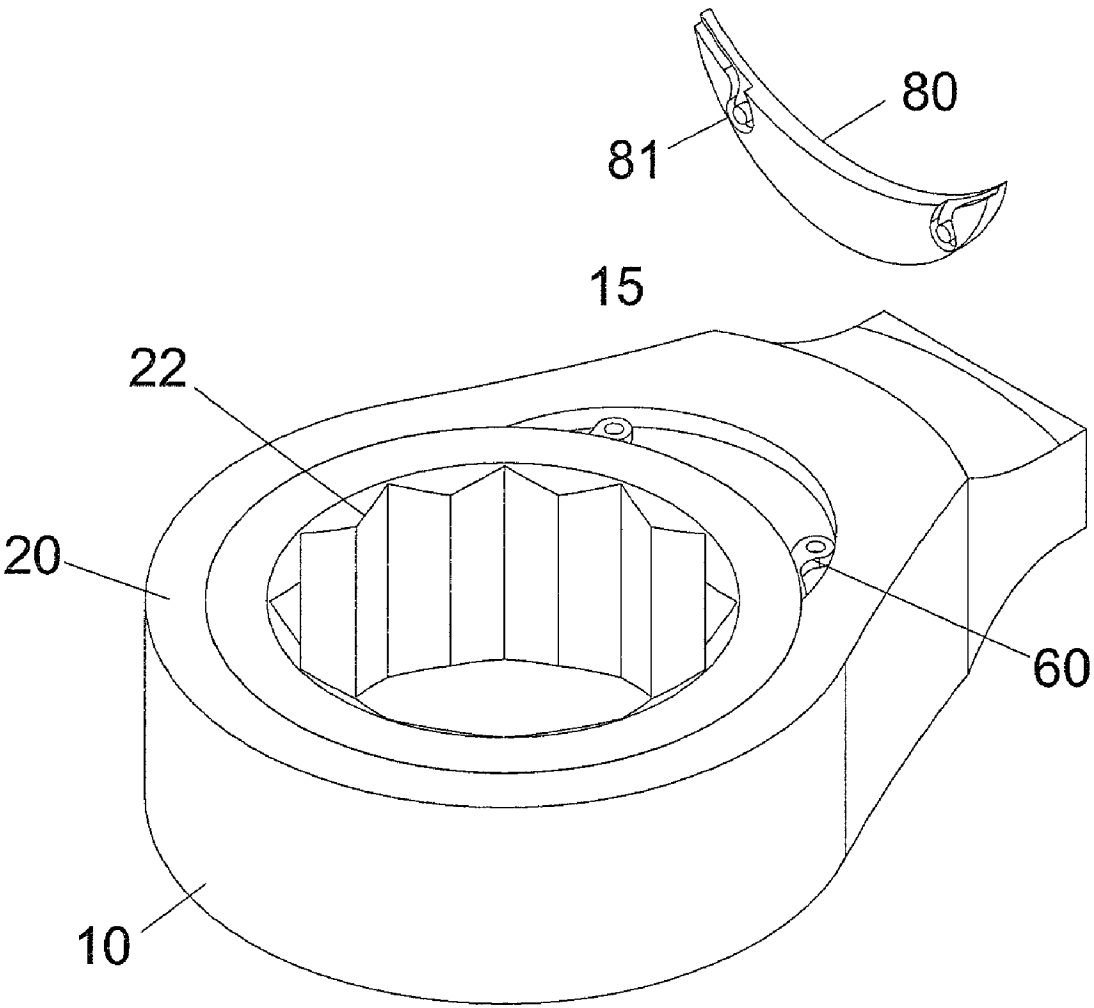
FIG. 8 is an exploded perspective view of the second embodiment in accordance with the present invention.

Referring to FIG. 8, in the second embodiment of the present invention, the convex trough 15 is covered by a convex lid 80 whose bottom side has two anchor troughs 81. The contour of the anchor trough 81 is in accordance with the shape of the free ends of the annular hook 60 for the free ends to be mounted in the anchor troughs 81. The convex lid 80 covers over the convex trough 15 and forms a smooth surface with the top surface of the head 10. The convex lid 80 can be made of plastic with different colors for distinction.

Figure 9:
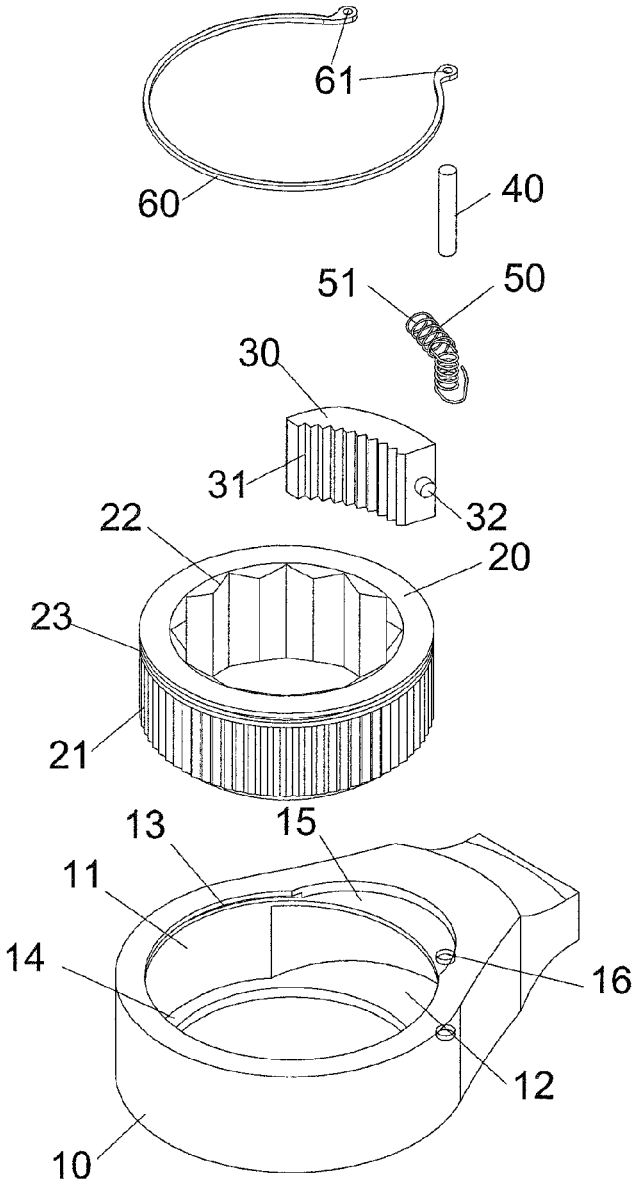
FIG. 9 is an exploded perspective view of the third embodiment in accordance with the present invention.
Figure 10:
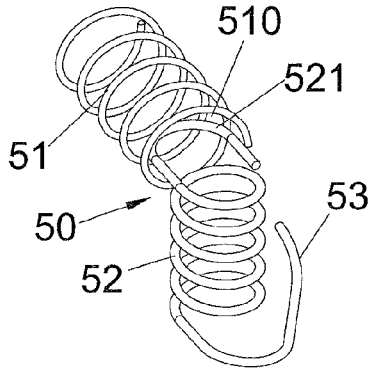
FIG. 10 is an enlarged drawing of the elastic assembly of the third embodiment in accordance with the present invention.
Figure 11:
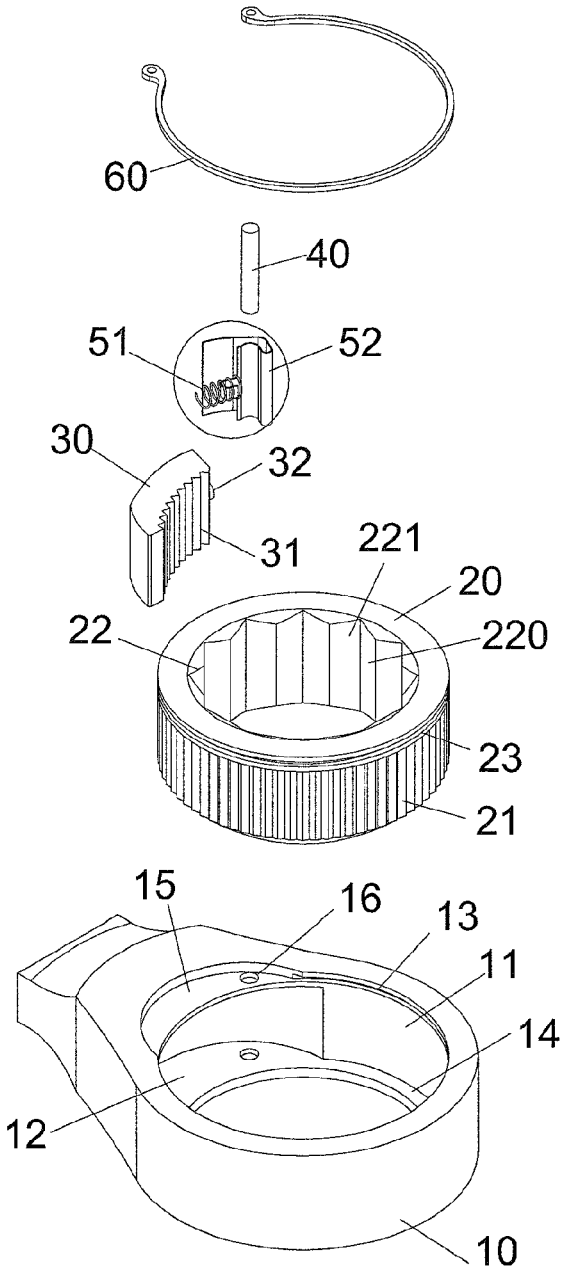
FIG. 11 is an exploded perspective view of the fourth embodiment in accordance with the present invention.
Figure 12:
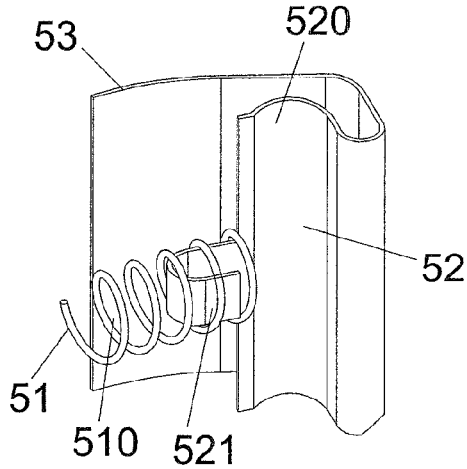
FIG. 12 is an enlarged drawing of the elastic assembly of the fourth embodiment in accordance with the present invention.
Figure 14:
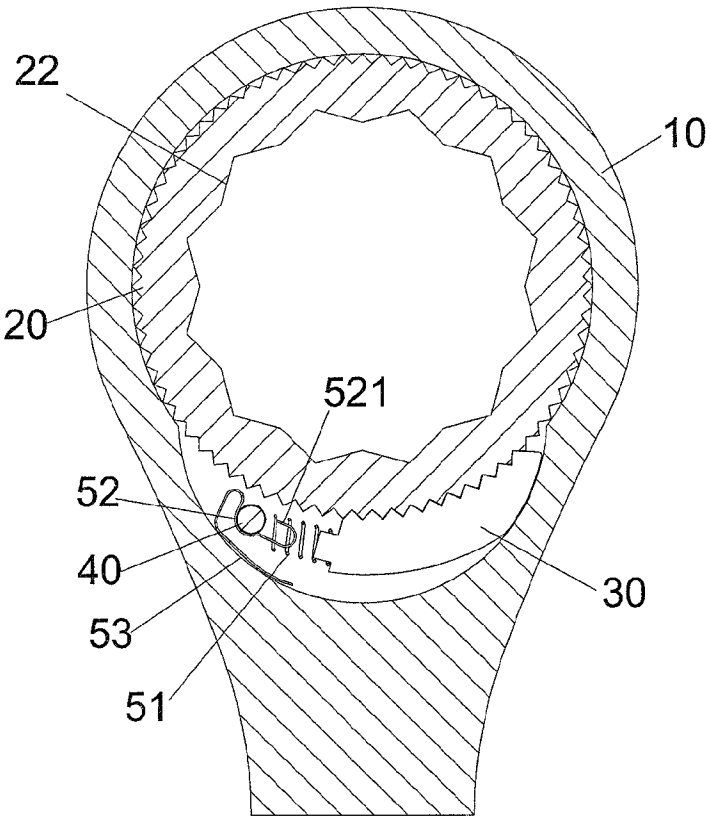
FIG. 14 is a cross sectional view taken along line B-B in FIG. 13.
Figure 13:
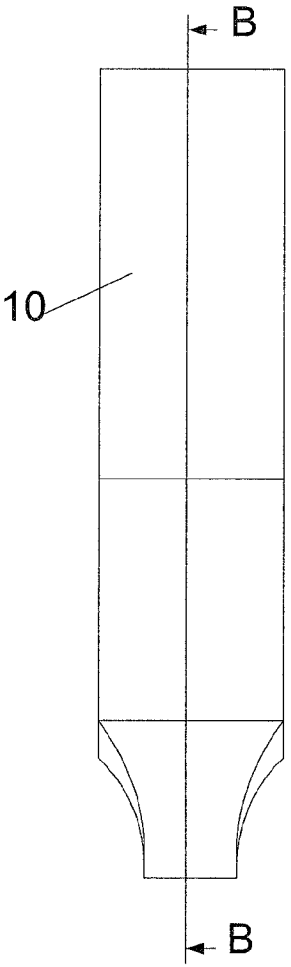
FIG. 13 is a side view of the fourth embodiment in accordance with the present invention.

Referring to FIGS. 9 and 10, in the third embodiment of the present invention, the second elastic element 51 and the first elastic element 52 of the elastic assembly 50 are two independent elements. A distal end of the first elastic element 52 has an extruded hook, linkage 521, which protrudes into the second loop 510 of the second elastic element 51 to connect with the second elastic element 51.

The pin 40 is inserted into the pin hole 16 of the head 10. When the annular hook 60 is engaged with the first annular groove 13, one of its free ends will stick against the top of the pin 40 to make the pin 40 to secure in the pin hole 16. Another way to position the pin 40 is to apply adhesive on the pin 40 and glue it in the pin hole 16.

Referring to FIGS. 11 to 14, in the fourth embodiment of the present invention, the first elastic element 52 of the elastic assembly 50 is made of a metal sheet, and the second elastic element 51 is made of a metal coil, where the second loop 510 is looped within. The first elastic element 52 still has a push element 53, a first loop 520 and a linkage 521 that allows the second loop 510 to hitch on.

Figure 15:
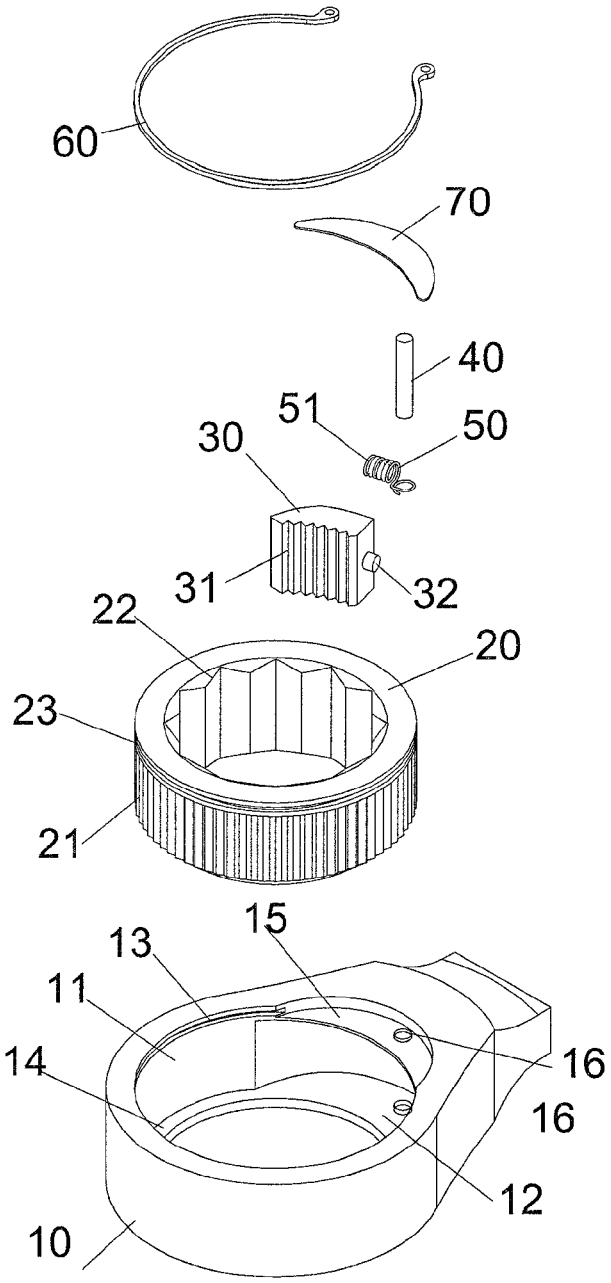
FIG. 15 is an exploded perspective view of the fifth embodiment in accordance with the present invention.
Figure 16:
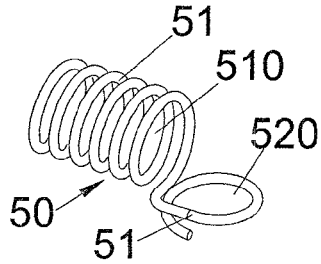
FIG. 16 is an enlarged drawing of the elastic assembly of the fifth embodiment in accordance with the present invention.

Referring to FIGS. 15 and 16, in the fifth embodiment of the present invention, the first elastic element 52 and the second elastic element 51 are made of the same metal coil. The first loop 520 and the second loop 510 are formed within the coil. The first elastic element 52 is a single loop.

Figure 17:
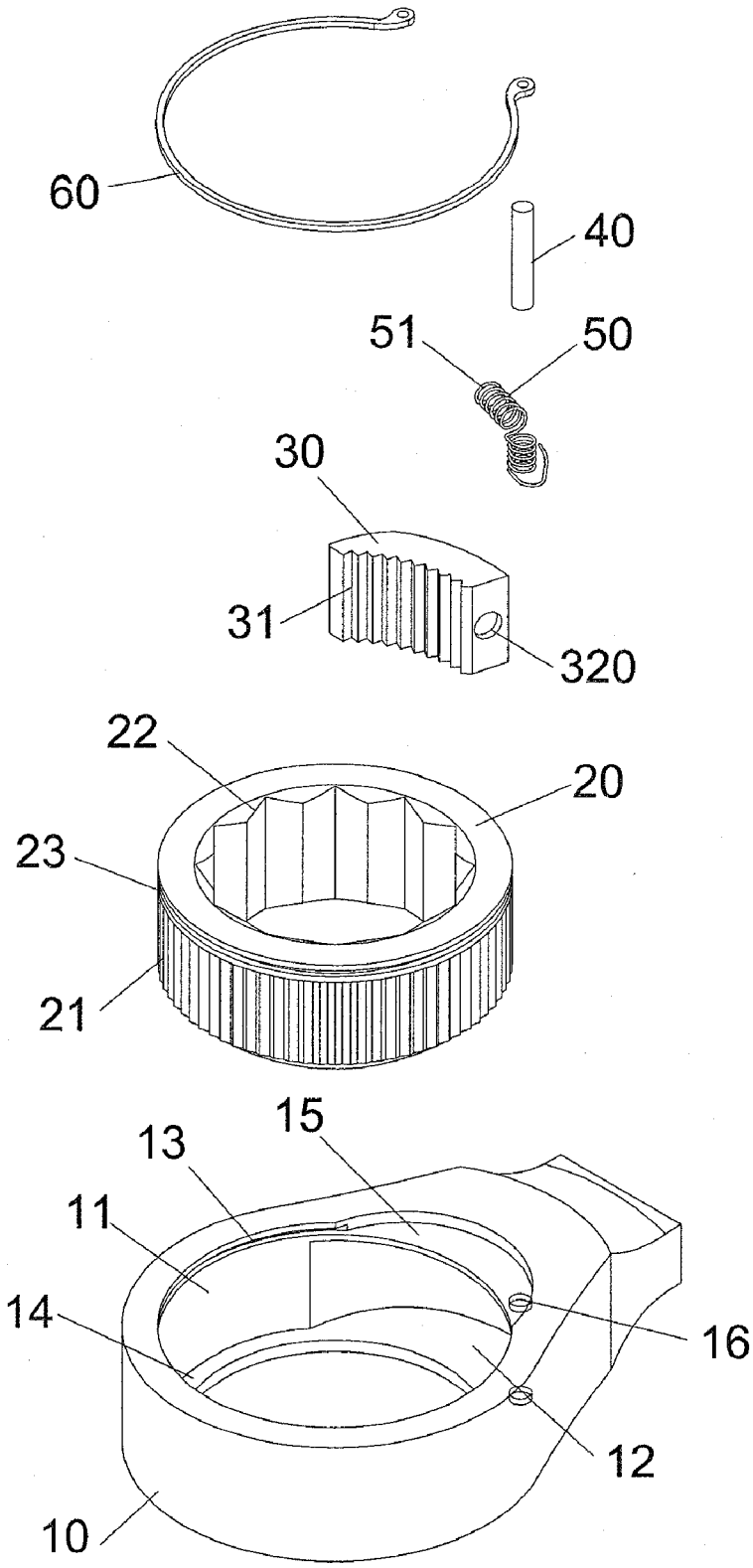
FIG. 17 is an exploded perspective view of the sixth embodiment in accordance with the present invention.

Referring to FIG. 17, in the sixth embodiment of the present invention, one end of the pawl 30 has a duct 320 for the second end of the second elastic element 51 of the elastic assembly 50 to insert and connect with the pawl.

Figure 18:
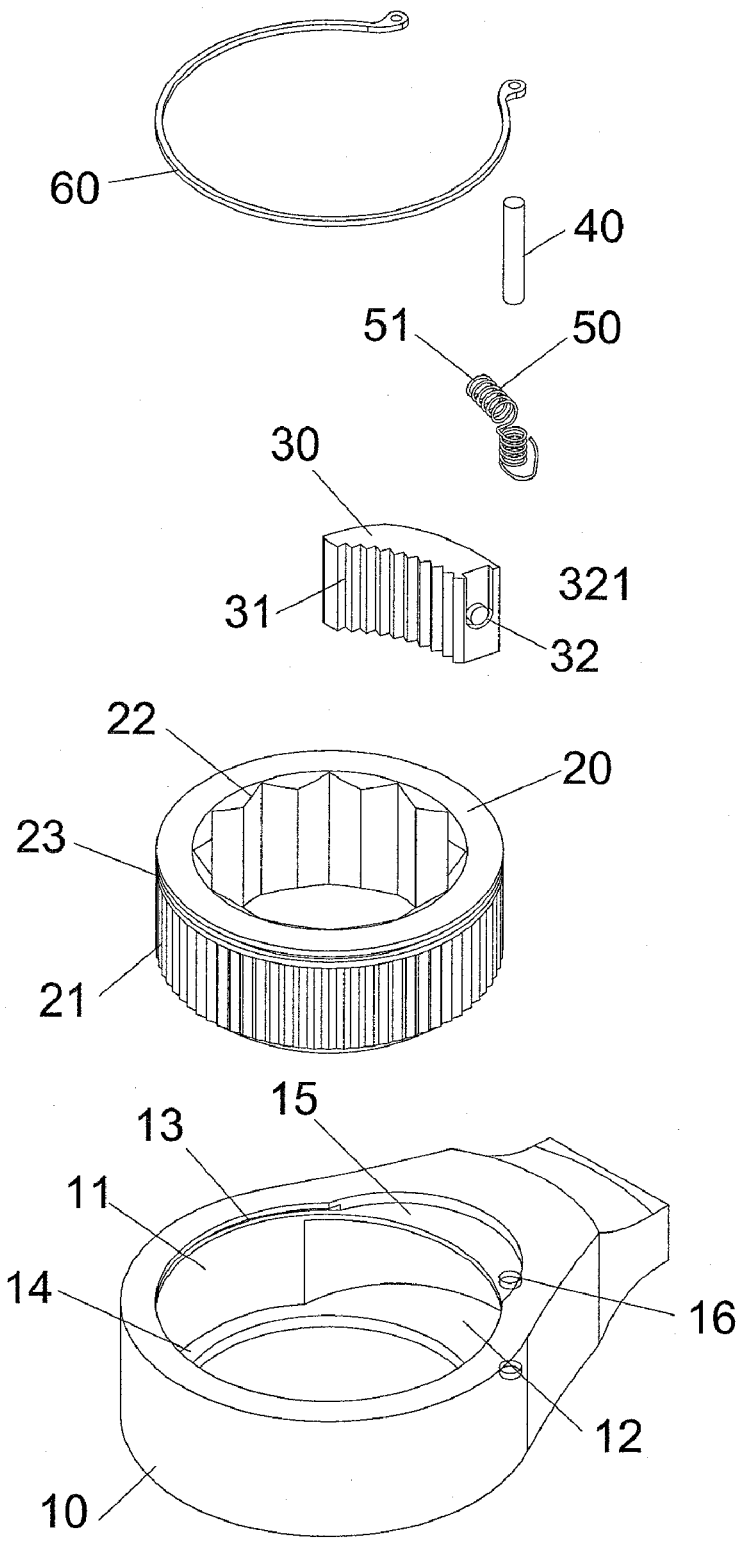
FIG. 18 is an exploded perspective view of the seventh embodiment in accordance with the present invention.

Referring to FIG. 18, in the seventh embodiment of the present invention, one end of the pawl 30 has a trough 321 with an upward opening and a column 32 extruded in the trough 321. The second elastic element 51 is inserted into the trough 321 and hitched on the column 32.

Figure 19:
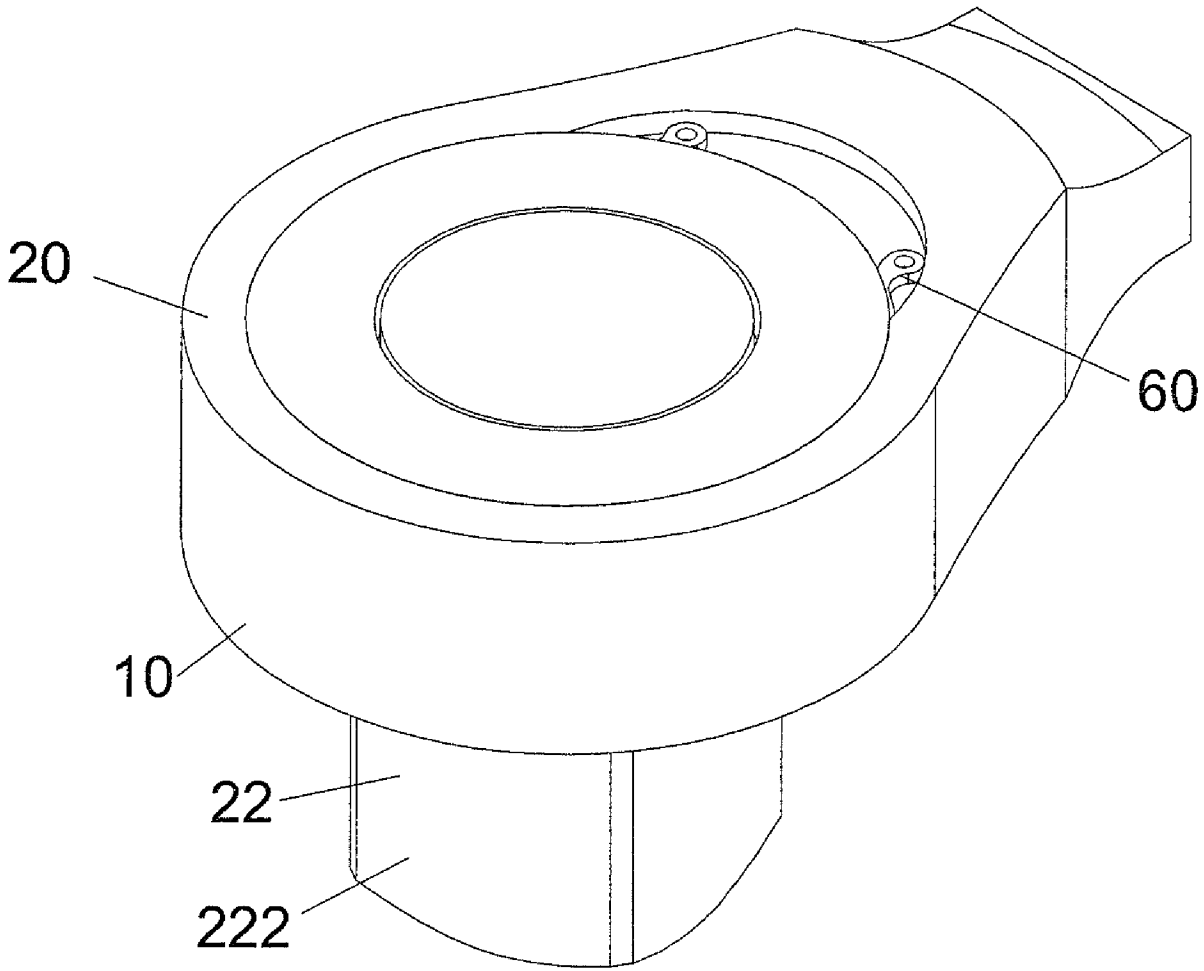
FIG. 19 is an exploded perspective view of the eighth embodiment in accordance with the present invention.

Referring to FIG. 19, in the eighth embodiment of the present invention, the receptacle 22 of the ratchet wheel 20 is a quadrilateral pillar 222.

Based upon above designs, the advantages of the present invention are summarized as bellow:

1. The present invention utilizes an elastic assembly 50 to make the pawl 30 engage with the ratchet wheel 20 for the objective of one-direction control, but the prior art disclosed in U.S. Pat. No. 6,539,825 needs three components to achieve the same objective. Therefore, the present invention uses fewer components and saves the cost for assembly.

2. In the present invention, a larger tolerance is allowed for the position and the diameter of the pin 40, but the function of one-direction control is not affected. The surfaces of the walls

120, 121 are flat and are easy for the pin hole 16 to be drilled. Therefore, the manufacturing process can be easier and more effective.

3. The elastic assembly 50 of the present invention is made of metal wire or metal sheet which doesn't require complicated manufacturing process, so that the cost can be reduced.

4. In the present invention, the first elastic element 52 of the elastic assembly 50 is hitched on the pin 40, and its height can be employed to centrally locate the second end of the second elastic element 51 relative to the pawl.

5. In the present invention, the first elastic element 52 of the elastic assembly 50 is hitched on the pin 40, and the push element 53 is stuck against the wall of the second cavity 12 for the elastic assembly 50 to be positioned in the second cavity 12 without contacting the ratchet wheel 20 and causing friction. It makes the assembly process easier.

6. In the present invention, the head 10 has a convex trough 15 that allows the free ends of the annular hook 60 to be mounted. Therefore, if any inner component is damaged, it can be replaced by opening the convex lid 80, dismounting the free ends of the annular hook 60 with pincers, and unloading the ratchet wheel 20.

While we have shown and described the embodiment in accordance with the present invention, it should be clear to those skilled in the art that further embodiments may be made without departing from the scope of the present invention.

What is claimed is:

1. An one-direction ratchet wrench comprising:

a driving head comprising:

a penetrated first cavity whose inner sidewall has a concaved first annular groove near its top portion and a protruded annular fringe near the bottom portion;

a curved second cavity with walls on its top and bottom portions respectively, extended from a sidewall of the first cavity, and a curved convex trough defined on a top of the top wall to communicate with the first annular groove, the center of the curved convex trough is on the same axis as the center of the second cavity, the diameter of the convex trough is less than or equal to the diameter of the second cavity;

a pin hole whose top portion links both the second cavity and the convex trough, and bottom portion ends at the top indent of the bottom wall;

a ratchet wheel rotatably mounted in the first cavity and held by the annular fringe to avoid falling apart from the wrench, having a plurality of ratchet teeth on its outer periphery and a receptacle at the middle for receiving and driving workpieces, and having a second annular groove at the top portion of its outer periphery for locating the second annular groove itself exactly corresponding to the first annular groove;

a pawl moveably located in the second cavity and one of its sides having a plurality of teeth engaged with the ratchet teeth of the ratchet wheel;

a pin being inserted in the pin hole;

an elastic assembly, placed inside the second cavity, comprising:

a first elastic element which has a first end, a second end, a first loop extending through the first end and the second end, and a push element extended outwards from the first end in the opposite direction of the first loop; the elastic push element, employed to hold onto the pin, being stuck against the wall of the second cavity and generating elasticity to make the first elastic element generate a torque relative to the pin; and a second elastic element which also has a first end, a second end and a second loop extending through the first end and the second end; the first end linking with the second end of the first elastic element; the second end being a free end employed to connect with the pawl; the axis of the second loop and the axis of the first loop having a ninety degree angle in between; the second elastic element being effectively connected with the pawl due to the torque from the first elastic element pushing the second elastic element;

a C shaped annular hook whose outer periphery is engaged in the first annular groove and inner periphery is engaged in the second annular groove, allowing the ratchet wheel rotatably mounted within the first cavity, and two free ends of the annular hook being extended into the convex trough; and a lid whose shape is in accordance with the contour of the convex trough, and the top of the lid being held and pressed by the two free ends of the annular hook to secure the lid.

2. The one-direction ratchet wrench as claimed in claim 1, wherein there are two thru-holes formed on the two ends of the annular hook respectively and both of the thru-holes are located in the convex trough.

3. The one-direction ratchet wrench as claimed in claim 1, wherein the receptacle has an penetrated receiving hole whose inner wall has twelve consecutive V shaped troughs annularly.

4. The one-direction ratchet wrench as claimed in claim 1, wherein the convex trough is covered by a convex lid whose bottom side has two anchor troughs, and the contour of the anchor trough is in accordance with the shape of the free ends of the annular hook for the free ends to be mounted in the anchor troughs.

5. The one-direction ratchet wrench as claimed in claim 4, wherein the convex lid is made of plastic.

6. The one-direction ratchet wrench as claimed in claim 1, wherein the second end of the first elastic element has an extruded linkage which protrudes into the second loop of the second elastic element to connect with the second elastic element.

7. The one-direction ratchet wrench as claimed in claim 1, wherein the first elastic element is formed by a metal sheet, and the second elastic element is spirally formed by a metal coil whose inner coil forms the second loop.

8. The one-direction ratchet wrench as claimed in claim 1, wherein the first elastic element is spirally formed by a metal coil whose inner coil forms the first loop, and the second elastic element is spirally formed by another metal coil whose inner coil forms the second loop.

9. The one-direction ratchet wrench as claimed in claim 1, wherein the first elastic element and the second elastic element are spirally formed by the same metal coil, and the first loop and the second loop are looped within the coil.

10. The one-direction ratchet wrench as claimed in claim 1, wherein one end of the pawl has a duct for the second end of the second elastic element to insert and connect with the pawl.

11. The one-direction ratchet wrench as claimed in claim 1, wherein one end of the pawl has a column for the second loop of the second elastic element to hitch on and connect with the pawl.

* * * * *